US006470922B2

(12) United States Patent
Sindermann

(10) Patent No.: US 6,470,922 B2
(45) Date of Patent: Oct. 29, 2002

(54) BOTTLING PLANT FOR BOTTLING CARBONATED BEVERAGES

(75) Inventor: Siegmar Sindermann, Kamen (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 0 days.

(21) Appl. No.: 09/808,411

(22) Filed: Mar. 14, 2001

(65) Prior Publication Data

US 2002/0023689 A1 Feb. 28, 2002

(30) Foreign Application Priority Data

Mar. 15, 2000 (DE) ..... 100 12 684

(51) Int. Cl.[7] ..... B65B 1/04

(52) U.S. Cl. ..... 141/37; 141/49; 141/63; 141/44

(58) Field of Search ..... 141/37–49, 67, 141/65, 92, 93, 94, 63

(56) References Cited

U.S. PATENT DOCUMENTS 5,445,194 A * 8/1995 Clusserath ..... 141/146
5,634,500 A * 6/1997 Clusserath et al. ..... 141/44
6,192,946 B1 * 2/2001 Clusserath ..... 141/40

FOREIGN PATENT DOCUMENTS

EP 0331137 9/1989

* cited by examiner

*Primary Examiner*—Steven O. Douglas
(74) *Attorney, Agent, or Firm*—Nils H. Ljungman & Associates

(57) ABSTRACT

Apparatus for the recovery of an inert gas, preferably for the recovery of $CO_2$, for use in counterpressure filling machines, the filling elements of which—prior to introduction of a liquid filling material into a container—evacuate this container and at least prepressurize this container with an inert gas under pressure from the pressurizing gas distribution channel:and which elements, during the subsequent introduction of a filling material, conduct the inert gas containing return gas displaced from a corresponding container into a return gas collection channel, wherein a first evacuation system is provided with which the air can be removed from the bottle, and then there is carried out a prepressurizing of the bottles using an inert gas; and a second independent evacuation system is provided with which can be removed and collected, independently of the first evacuation, the inert gas that is being removed by suction.

20 Claims, 2 Drawing Sheets

BOTTLING PLANT FOR BOTTLING CARBONATED BEVERAGES

BACKGROUND OF THE INVENTION

1. Field of the Invention

The invention relates to an apparatus for the recovery of an inert gas, particularly, for recovering $CO_2$ gas, for use in counterpressure filling machines, the filling elements of which—prior to introduction of a liquid filling material into a container—evacuate this container and at least prepressurize this container with an inert gas under pressure from the pressurizing gas distribution channel, and which elements, during the subsequent introduction of a filling material, conduct the inert gas containing return gas displaced from a corresponding container into a return gas collection channel.

2. Background Information

Such a method and a corresponding apparatus for filling a liquid, especially carbon dioxide-containing filling material under counterpressure into bottles or the like containers, are known (EP A03 31 137). In this, it has also been proposed, in order to reduce the consumption of inert gas, or, respectively, $CO_2$ gas, in the pressurizing phase, to utilize, for rinsing/washing, or purging, or flushing, as well as for partial prepressurizing of the corresponding container, return gas from a return gas channel of the filling machine, by which channel is removed return gas that has been displaced during filling of the containers. The return gas channel contains the return gas under a predetermined pressure and is in communication with a conduit by way of which excess of return gas is passed, for example, to the atmosphere or to the equipment for the preparation of inert gas. By way of utilization of the return gas from the return gas channel for rinsing/washing and partial prepressurizing of the containers there results a reduction in consumption of an inert gas. However, it is of detriment that all of the inert gas, displaced during filling from the corresponding container, is reaching the return gas channel—the pressure of which is markedly below the filling pressure, that is, below that pressure which is present in the interior space of the corresponding container at the conclusion of prepressurizing. The inert gas that is displaced during filling can, accordingly, be reused only for the rinsing/washing and the partial prepressurizing.

It is further known to utilize in counterpressure filling machines that return gas which is in the form of a $CO_2$-air-mixture and which is obtained during the filling of containers or, respectively, bottles—which hereinafter is referred to as "inert gas", and in this especially as $CO_2$ gas, and which comprises a large quantity of $CO_2$, with an order of magnitude of 80 to 90 percent, after a conditioning or, respectively, recovering of the pressurizing gas for the prepressurizing—but also to the preceding rinsing/washing of the containers to be filled in order to reduce the $CO_2$ consumption and to protect the environment due to the reduced release of $CO_2$ gas. The recovery is carried out in this essentially thereby that in a mixing apparatus pure $CO_2$ is added to the $CO_2$ gas that is present as return gas.

OBJECT OF THE INVENTION

It is the aim of the invention to provide an apparatus for such a recover, which apparatus ensures the provision of an inert gas with greatly improved quality and to improve a method, or, respectively, an apparatus of the type referred to in the foregoing, in such a way that there results a substantial reduction of also the required amount of inert gas which is maintained at the filling pressure.

SUMMARY OF THE INVENTION

The invention teaches that this object can be accomplished by an apparatus for the recovery of an inert gas characterized thereby that a first evacuation system is provided with which the air can be removed from the bottle, and then there is carried out a prepressurizing of the bottles using an inert gas; and a second evacuation system is provided with which can be removed and collected, independently of the first evacuation, the inert gas that is being removed by suction.

BRIEF DESCRIPTION OF THE DRAWINGS

The invention is further explained on the basis of the figures. There is shown in.

DESCRIPTION OF THE PREFERRED EMBODIMENT

Figure 1:
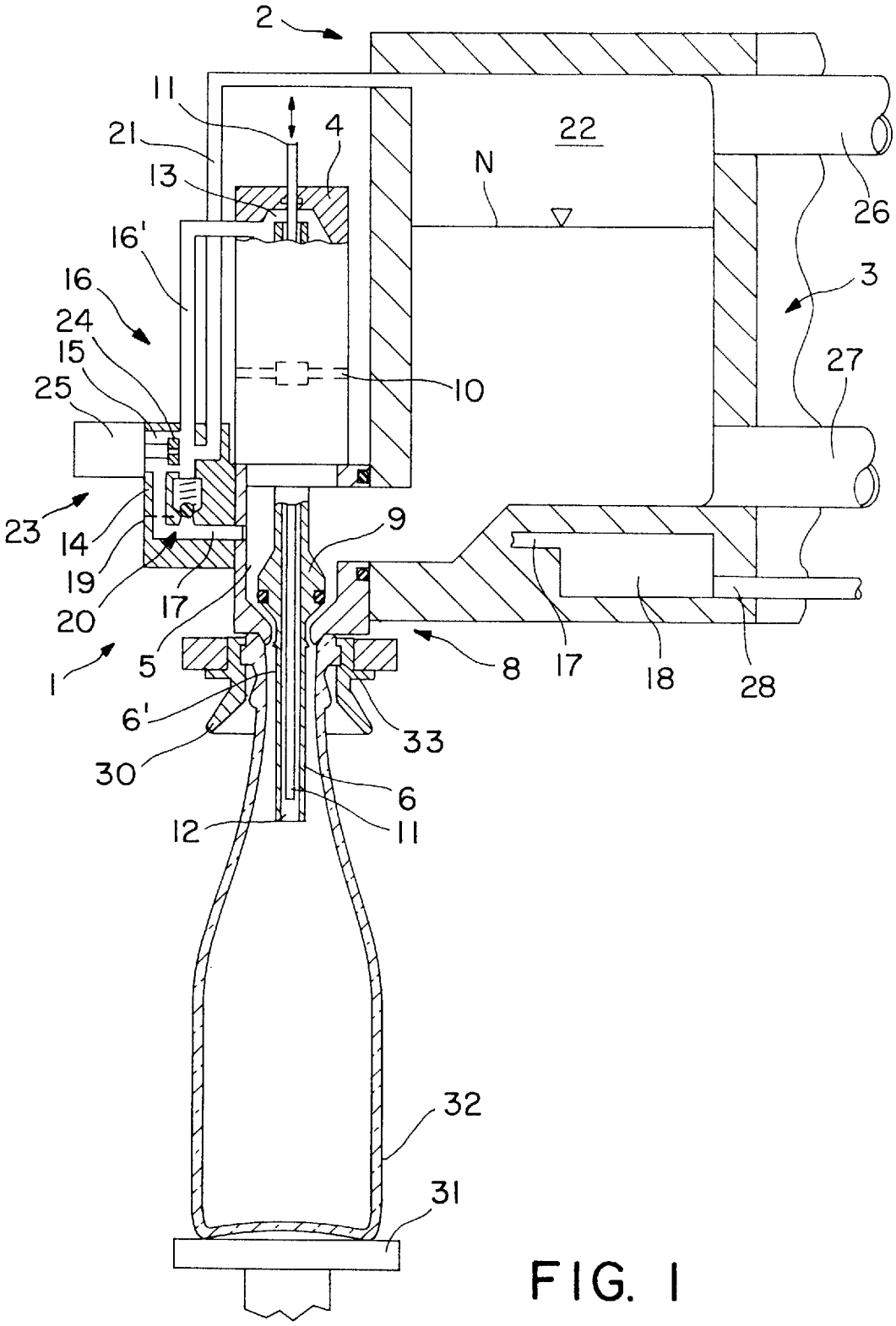
FIG. 1: in simplified presentation and in cross-section, one filling element of a plurality of filling elements provided at the circumference of a rotor that revolves about a vertical axis of rotation of a counterpressure filling machine of revolving construction, together with a bottle that is to be filled.

The reference numeral 1 designates a filling element that is provided, together with further filling elements 1 of the same configuration, at the circumference of a rotor 3 which revolves about a vertical machine axis and forms an annular boiler 2.

The filling element 1 is basically configured by a housing 4 secured at the rotor 3 in which housing is provided a fluid channel 5. In its upper region this channel is in communication with the annular boiler 2 and with its lower region it forms an annular output opening 7 which surrounds a gas conduit 6 for the liquid filling material.

In the fluid channel 5 is further contemplated a fluid valve 8 which is configured in customary manner with a valve body 9 which interacts with a valve seat disposed in the interior of the fluid channel. The valve body 9 is contemplated, in the illustrated embodiment, on the gas conduit 6 that projects in its axis in vertical direction and parallel to the axis of the machine over the underside of the filling element 1 and the housing 4. In FIG. 1 the fluid valve is shown in the closed position. Release of the fluid valve 8 is by way of a pneumatic actuating apparatus. This actuating apparatus—which acts upon the portion of the gas conduit 6 that is located above the valve body 9—comprises as actuating element, for example, a piston, preferably, however, a membrane, which is schematically illustrated at 10 in FIG. 1 with dash lines.

A sensor 11 is disposed in the gas conduit 6 which senses the filling height, which sensor is surrounded at a distance by the gas conduit 6 such that within the gas conduit 6 a gas channel 12 is provided which surrounds the sensor 11 in annular manner and which is open at the lower end of the gas conduit 6. At the upper end of the gas conduit 6 the gas channel 12 merges into a chamber 13 which is provided in the housing 4 and which is closed with respect to the exterior.

At that side of the housing 4, which is positioned radially outwardly related to the machine axis, is contemplated a valve housing 14 which forms a closed chamber 15 which is closed with respect to the exterior. The latter is permanently connected, via a conduit or a channel 16', with the chamber 13. The channel 16' provides, together with the gas channel 12, a gas path 16. The chamber 15 is furthermore in permanent communication—via a gas path 17 which extends in part in the valve housing 14, in part in housing 4, and in part in the rotor component 3—with a return gas channel 18 provided in the rotor component 3 and which is common to all filling elements 1. In the portion of the gas path 17 formed in the in the valve housing 14 there is provided a choke/throttle or, respectively, a nozzle 19. Parallel with respect to this nozzle 19, the gas path 17 provides a bypass in which is arranged a check valve 20. This check valve 20, which in the embodiment is illustrated by a ball forming the valve body and a spring, is configured in such a way that in a flow direction exiting from the gas path 17 into the chamber 15 it opens and it precludes a flow in the opposite direction.

In addition the chamber 15 is in communication, via a third gas path 21—provided by a conduit or by a channel—with a gas compartment 22 which compartment is provided above the level of filling material in the not fully filled but only to a predetermined level "N" with the liquid filling material filled. annular boiler 2. The communication between the gas path 21 and the chamber 15 is controlled by a control valve 23 which closes—the gas path 21 with its valve body 24—in the illustrated embodiment of FIG. 1—in non-actuated condition, at the juncture into the chamber 15. The control valve 23 can be actuated pneumatically or electrically, and in like manner, and comprises an actuating apparatus 25.

FIG. 1 furthermore shows various conduits, namely, a conduit 26 leading into the gas compartment 22 by way of which to this gas compartment 22 is brought, in controlled manner, pressurizing gas and this is done in such a way that in the gas compartment 22 a predetermined pressure is maintained.

By way of conduit 27 the liquid filling material is passed to the annular boiler 2 and this is controlled in such a way that a desired level "N" of the liquid filling material (within a predetermined fluctuation range) is maintained. The conduit 28 which merges into the remaining gas channel 18 in the illustrated embodiment leads, via a pressure control apparatus, either to a $CO_2$ preparation equipment, or into the gas compartment 22.

Reference numeral 30 identifies a customary centering bell, 31 identifies a bottle carrier that can be raised and lowered and 32 identifies a bottle positioned on this bottle carrier which bottle, is pressed for filling in customary manner against the filling element 1 and with its mouth under cooperation of a seal 33 is brought into the sealing position against the filling element 1. The gas conduit has above its lower end an opening 6' for the gas channel 12 the cross-sectional extent of which is less than the cross-sectional extent of the gas channel 12. This filling valve is described only for the purpose of general explanation. There may be provided further conduits and control apparatus and so forth, at such a filling valve and at the filling machine with which may be carried out additional procedures and the like. Thus, it is within the scope of the invention to provide steam conduits for introduction and removal, with which can be carried out a steam cleaning/rinsing for removal of the remaining air and/or for the purpose of sterilization and so forth.

Figure 2:
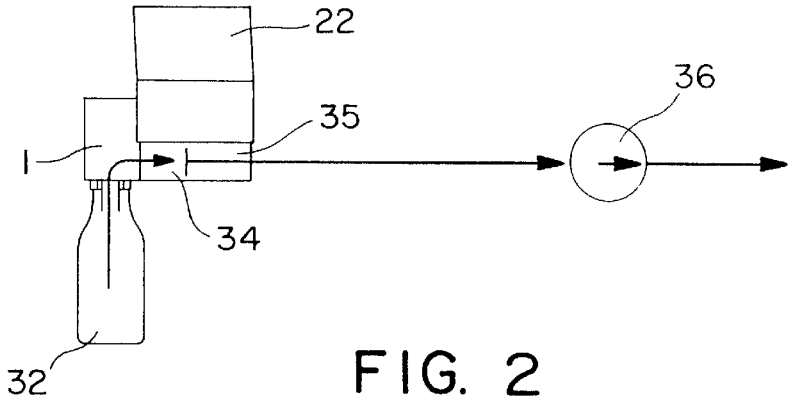
FIG. 2: the embodiment of the invention in accordance with one aspect.

In accordance with the embodiment of FIG. 2, there are provided, additionally, a first 34 and a second evacuation channel 35, i.e., channels for removing air or inert gas by vacuum. This means that prior to the actual prepressurizing using an inert gas initially upon positioning of the bottle 32 there is performed a first evacuation through the channel 34, by means of which the air present in the bottle is withdrawn and blown into the surrounding free space. Following this first evacuation, $CO_2$ is passed from the gas compartment 22 or another compartment or channel through the gas channel 12 of the gas conduit 6 into the bottle 32. Upon prepressurizing thereof (bottle), a further evacuation is carried out through the second evacuation channel 35 with nearly pure $CO_2$, via a separate, second evacuation apparatus. This $CO_2$ removed by way of the second evacuation channel 35 is passed to a $CO_2$ recovery, or refining, and/or treatment/processing equipment. $CO_2$ won in this manner is again passed for further processing to the filling machine or, respectively, the gas compartment 22 with a predetermined pressurizing gas pressure.

After the second evacuation procedure, the bottle 32 containing $CO_2$ from the gas compartment 22 as described above, for the purpose of a repeated prepressurizing is passed to such prepressurizing, whereupon by opening of the valve body 9 the filling procedure can be carried out with subsequent depressurization and withdrawal of the bottle 32 in known manner.

The two evacuation systems are preferably units that are separate from one another with each also being provided, respectively, with a vacuum pump 36 and 37.

The above-discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintain that this application may include more than one patentably and non-obviously distinct invention. The Applicants hereby assert that the disclosure of this application may include more than one invention, and, in the event that there is more than one invention, that these inventions may be patentable and non-obvious one with respect to the other.

FIG. 4 shows one example of a system for filling containers which could possibly utilize the present invention. FIG. 1 shows a rinser 101, to which the containers, namely bottles 102, are fed in the direction indicated by the arrow A1 by means of a conveyor line 103, and downstream of which, in the direction of travel, the rinsed bottles 102 are transported by means of a conveyor line 104 formed by a star wheel conveyor to a filling machine 105 or its inlet star wheel. Downstream of the filling machine 105, in the direction of travel of the bottles 102, there can preferably be a closer 106 which closes the bottles 102. The closer 106 can be connected directly to a labelling device 108 by means of a conveyor line 107 formed by a plurality of star wheel conveyors. In the illustrated embodiment, the labelling device 108 has three outputs, namely one output formed by a conveyor 109 for bottles 102 which are filled with a first product, from product mixer 123 through conduit 121 and are then labelled corresponding-to this product, a second output formed by a conveyor 110 for those bottles 102 which are filled with a second product from product mixer 124 through conduit 122 and are then labelled corresponding to this product, and a third output formed by a conveyor 111 which removes any bottles 102 which have been incorrectly labelled.

In FIG. 4, 112 is a central control unit or, expressed differently, controller or system which includes a process controller which, among other things, controls the operation of the above-referenced system.

Figure 3:
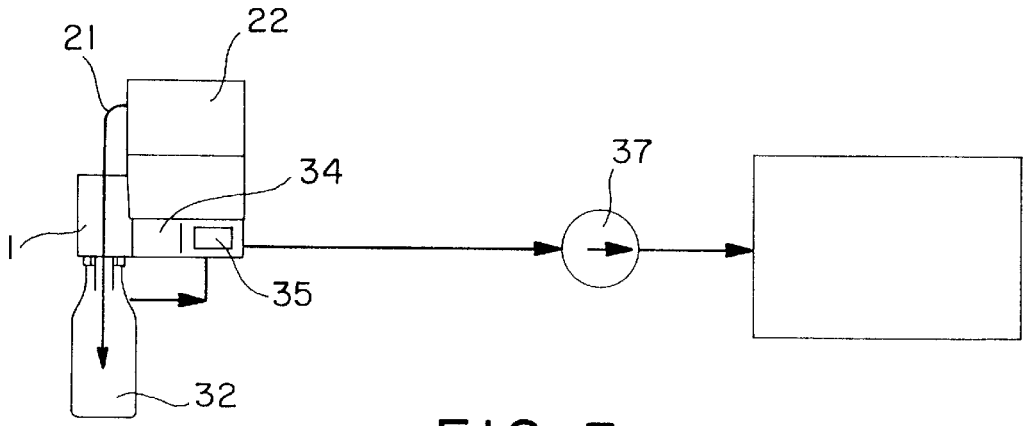
FIG. 3: the removal of the inert gas.

The filling machine 105 is preferably of the revolving design, with a rotor 105' which revolves around a vertical machine axis. On the periphery of the rotor 105' there are a number of filling positions 113, each of which consists of bottle carriers or container carriers (not shown, but compare element 5 in FIGS. 3 and 4), as well as a filling element 114 located above the corresponding container carrier. The toroidal vessel 117 is a component of the revolving rotor 105'. The toroidal vessel 117 can be connected by means of a rotary coupling and by means of an external connecting line 121 to an external reservoir or mixer 123 to supply the product, that is, product mix 1, for example.

As well as the more typical filling machines having one toroidal vessel, it is possible that in at least one possible embodiment of the present invention a filling machine could possibly be utilized wherein each filling element 114 is preferably connected by means of two connections to a toroidal vessel 117 which contains a first product (by means of a first connection, for example, 121) and to a second toroidal vessel which contains a second product (by means of the second, connection, for example, 122). In this case, each filling element 114 can also preferably have, at the connections, two individually-controllable fluid or control valves, so that in each bottle 102 which is delivered at the inlet of the filling machine 105 to a filling position 113, the first product or the second product can be filled by means of an appropriate control of the filling product or fluid valves.

It will be understood that while a two-product assembly is illustrated in FIG. 4, that the invention is equally applicable to single-product installations, or other commensurate embodiments.

FIG. 5 illustrates one possible embodiment of filling bottles and stabilizing the pressurization in such bottles. Thus, bottles which are possibly passed from a washing station or step are positioned in step 200 at a filling element. It will be understood that this positioning may possibly include a secure attachment of the corresponding bottle to the filling element, i.e., a sealed connection may be made. In step 201 air is removed from the corresponding bottle by a first evacuation system. This will possibly render the bottle with an underpressure to facilitate filling of the bottle with filling liquid. In step 202 pre-pressurizing of the bottle is carried out using an inert gas, preferably $CO_2$.

Simultaneously or subsequently, filling of the bottle, step 203, with a liquid beverage may possibly be carried out. The bottle is possibly next brought to the desired bottling pressure or stabilized pressure, by final pressurizing step 204. Thus, next can possibly be a recovery of the inert gas remaining in the bottle, step 205. As is stated elsewhere, this is preferably achieved using a second evacuation system. Thus, the first evacuation system of step 201 and the second evacuation system of step 205 are distinct systems which possibly operate independently of one another. It will be appreciated that the volume flows are controlled as to rate and the like parameters such as temperature, pressure, etc. as will be dictated by the particular beverage that is to be bottled.

In step 206 the filled and possibly pressurized bottles are removed from the filing element or station. Such properly filled and pressurized bottles may possibly be passed to capping or closing and thence to crating and shipping.

Examples of apparatus and procedures to measure carbon dioxide ($CO_2$) content or concentration and which may possibly be incorporated in embodiments of the present invention may be found in: U.S. Pat. No. 4,801,551 issued to Byers et al. on Jan. 31, 1989 and entitled "Rugged dissolved carbon dioxide monitor for high purity water"; U.S. Pat. No. 5,029,103 issued to Carbide on Jul. 2, 1991 and entitled "Carbon dioxide monitor"; U.S. Pat. No. 5,068,090 issued to Connolly on Nov. 26, 1991 and entitled "Aqueous carbon dioxide monitor"; and U.S. Pat. No. 5,252,491 issued to Connolly on Oct. 12, 1993 and entitled "Aqueous carbon dioxide monitor", all of these U.S. patents being hereby expressly incorporated by reference as if set forth in their entirety herein.

Examples of apparatus and methods for sensing or measuring temperature parameters and which may possibly be utilized in connection with the present invention are to be found in: U.S. Pat. No. 4,038,873 issued to Kimmel on Aug. 2, 1977 and entitled "Temperature monitor and indicator"; U.S. Pat. No. 4,278,841 issued to Regennitter et al. on Jul. 14, 1981 and entitled "Multiple station temperature monitor system"; U.S. Pat. No. 4,623,265 issued to Poyser on Nov. 18, 1986 and entitled "Transformer hot-spot temperature monitor"; U.S. Pat. No. 4,802,772 issued to Chianese on Feb. 7, 1989 and entitled "Nonelectric temperature monitor"; U.S. Pat. No. 5,469,855 issued to Pompei et al. on Nov. 28, 1995 and entitled "Continuous temperature monitor"; U.S. Pat. No. 5,511,415 issued to Nair et al. on Apr. 30, 1996 and entitled "Gas flow and temperature probe and gas flow and temperature monitor system including one or more such probes"; U.S. Pat. No. 5,531,191 issued to Davis on Jul. 2, 1996 and entitled "Fluid temperature monitor"; U.S. Pat. No. 5,563,239 issued to Pompei et al. on Aug. 5, 1997 and entitled "Continuous temperature monitor"; U.S. Pat. No. 5,662,419 issued to Lamagna on Sep. 2, 1997 and entitled "Time-temperature monitor and recording device and method for using the same"; U.S. Pat. No. 5,708,412 issued to Proulx on Jan. 13, 1998 and entitled "Fluid level and temperature monitor and alarm system"; and U.S. Pat. No. 5,890,100 issued on Mar. 30, 1999 to Crayford and entitled "Chip temperature monitor using delay lines", all of these U.S. patents being hereby expressly incorporated by reference as if set forth in their entirety herein.

Examples of apparatus and methods for determining parameters such as the filling volume, the empty volume, and the filling height which may possibly be utilized in embodiments of the present invention may be found in: U.S. Pat. No. 4,134,407 issued to Elam on Jan. 16, 1979 and entitled "External pressurevolume monitor"; U.S. Pat. No. 4,282,757 issued to Cohn on Aug. 11, 1981 and entitled "Device for detecting rate of change in pressure"; U.S. Pat. No. 4,391,412 issued to Goldhammer on Jul. 5, 1983 and entitled "Apparatus for limiting filling height of containers"; U.S. Pat. No. 4,765,342 issued to Urman et al. on Aug. 23, 1988 and entitled "Timed drift compensation for rate volume monitor"; U.S. Pat. No. 4,788,456 issued to Urman et al. on Nov. 29, 1988 and entitled "Variable threshold for rate volume monitor"; U.S. Pat. No. 4,928,687 issued to Lampotang et al. on May 29, 1990 and entitled "$CO_2$ diagnostic monitor"; U.S. Pat. No. 5,008,653 issued to Kidd et al. on Apr. 16, 1991 and entitled "Fluid detector with overfill probe"; U.S. Pat. No. 5,110,208 issued to Sreepada et al. on May 5, 1992 and entitled "Measurement of average density and relative volumes in a dispersed two-phase fluid"; U.S. Pat. No. 5,244,550 issued to Inoue on Sep. 14, 1993 and entitled "Two liquid separating methods and apparatuses for implementing them"; U.S. Pat. No. 5,279,157 issued to Mattis et al. on Jan. 18, 1994 and entitled "Liquid level monitor"; and U.S. Pat. No. 6,099,470 issued to Bahr on Aug. 8, 2000 and entitled "Monitor for diffusable chemical substance", all of these U.S. patents being hereby expressly incorporated by reference as if set forth in their entirety herein.

Examples of apparatus and/or methods which may possibly be incorporated in a possible embodiment of our present invention that may possibly work under the control of pneumatic pressure may be found in: U.S. Pat. No. 4,044,732 issued to Inada et al. on Aug. 30, 1977 and entitled "Pneumatic control system and pressure responsive valve assembly therefor"; U.S. Pat. No. 4,576,194 issued to Lucas et al. on Mar. 18, 1986 and entitled "Pneumatic control system, control means therefor and method of making the same"; U.S. Pat. No. 4,679,583 issued to Lucas et al. on Jul. 14, 1987 and entitled "Pneumatic control system, control means therefor and method of making the same"; U.S. Pat. No. Re 34,202 issued to Kautz on Mar. 30, 1993 and entitled "Dual mode pneumatic control system"; U.S. Pat. No. 5,642,271 issued to Henderson on Jun. 24, 1997 and entitled "Pneumatic control system"; U.S. Pat. No. 5,816,132 issued to Langner et al. on Oct. 6, 1998 and entitled "Load-sensing pneumatic control system"; and U.S. Pat. No. 6,129,002 issued to Lisec et al. on Oct. 10, 2000 and entitled "Valve arrangement, especially for a pneumatic control system", all of these U.S. patents being hereby expressly incorporated by reference as if set forth in their entirety herein.

Examples of apparatus and/or methods which may possibly be incorporated in a possible embodiment of our present invention that may possibly work under the control of hydraulic pressure may be found in: U.S. Pat. No. 5,513,551 issued to Morishita on May 7, 1996 and entitled "Hydraulic control system"; U.S. Pat. No. 5,579,642 issued to Wilke et al. on Dec. 3, 1996 and entitled "Pressure compensating hydraulic control system"; U.S. Pat. No. 5,718,115 issued to Burkner on Feb. 17, 1998 and entitled "Constant force hydraulic control System"; U.S. Pat. No. 5,758,499 issued to Sugiyama.et al. on Jun. 2, 1998 and entitled "Hydraulic control system"; U.S. Pat. No. 5,832,729 issued to Reid et al. on Nov. 10, 1998 and entitled "Hydraulic control system"; U.S. Pat. No. 5,921,165 issued to Takahashi et al. on Jul. 13, 1999 and entitled "Hydraulic control system"; and U.S. Pat. No. 6,062,331 issued to Grunow et al. on May 16, 2000 and entitled "Auxiliary hydraulic control system for a work machine", all of these U.S. patents being hereby expressly incorporated by reference as if set forth in their entirety herein.

The features disclosed in the various publications, disclosed or incorporated by reference herein, may be used in the embodiments of the present invention, as well as, equivalents thereof.

The appended drawings in their entirety, including all embodiments dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 100 08 426, filed on Feb. 23, 2000, having inventors Ludwig CLUSSERATH and Manfred HARTEL, and DE-OS 100 08 426 and DE-PS 100 08 426, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

In the claims, means-plus-function clauses are intended to cover the structures described herein as performing the recited function and not only structural equivalents but also equivalent structures.

While our invention has other applicability, our present invention has most applicability in machinery of KHS Maschinenund Anlagenbau Aktiengesellechaft of Dortmund, Federal Republic of Germany, and such machinery may be viewed on the company's website under www.khs-ag.de, particularly under the webpage www.khsag.de/en/05products/lmachines.

The website shows aspects of cleaning technology (INNOCLEAN), namely, single-end bottle washers of which there are three versions of the INNOCLEAN single-end bottle washer. The machines offered range from the lowest capacity (INNOCLEAN EC) with an output of 10,000 bottles per hour, the mid-capacity of 10,000 to 30,000 bottles per hour (INNOCLEAN EK), to machines with capacities for 150,000 bottles per hour (INNOCLEAN EE+INNOCLEAN EM, also available as multiple bath versions). All models have been designed for washing returnable and nonreturnable glass and PET bottles. Double-end bottle washers: the INNOCLEAN DM double-end, multiple-bath bottle washer is designed for the mid to high capacity range of up to 150,000 bottles per hour. This machine fulfills the highest possible bottle requirements by consistently separating the impurities from the clean bottle discharge. Very long treatment periods can be achieved by combining a series of various types of caustic baths. The INNOCLEAN DM is available in various overall heights. The INNOCLEAN DMT product line machines are double-end bottle washers with modified automation. Crate washers: the INNOCLEAN KW is a fully automatic washing system for plastic crates. Made entirely of stainless steel, single or two-vat versions are available of these single and double-track machines. Capacities range from 500 to 10,000 crates per hour. Crates are washed by two optional types of high-pressure spraying: 1. hot water and follow-up spraying, 2. caustic spraying, hot water and follow-up spraying.

Washing and filling technology for kegs—INNOKEG: comprising keg washers and fillers—whether the INNOKEG RF-SW for the lower capacity range or the linear INNOKEG RF-MP and RFDP (single and double-conveyor versions) for the mid and upper capacity range, the tried and tested INNOKEG RF product line is the center of attention of the KHS keg systems for the beverage industry. Keg interior cleaning, sterilization, and keg filling is performed fully automatically. Ideal for filling carbonated and non-carbonated beverages such as beer, soft drinks, mineral water, wine and fruit juices. Rotary fillers: the INNOKEG KR is continuous operation (rotary-type) keg treatment machine-filler. It is suitable for filling kegs and containers equipped with central fitting systems and ideal for filling carbonated and noncarbonated beverages such as beer, juice, mineral water, wine and fruit juices. The INNOKEG KR is available in four capacity ranges: up to 600 kegs per hour, filler with 16 filling elements; up to 800 kegs per hour, filler with 20 filling elements; up to 1,000 kegs per hour, filler with 24 filling elements. More than 1,000 kegs per hour, filler with 32 filling elements. Pretreatment and checking;

the INNOKEG product line offers several machine models for pre-treatment and checking of kegs: 1. the INNOKEG AR keg exterior washer, a completely covered tunnel machine for treatment of keg exteriors (capacity 60 to 1,200 kegs per hour); 2. the multiple head INNOKEG MK used for checking the condition of kegs such as cap stripper and check re-tightener, residual pressure check as well as optical distortion checking 70–1,100 kegs per hour capacity (depending on the equipment). Keg handling machines: KHS has a number of keg handling machines in its INNOKEG program: from protective cap cappers and decappers (INNOKEG PM-BK/PM-EK) to the keg program turner (INNOKEG PM-PW) for repositioning horizontally palletized kegs so that fittings point inward or outward. This product line is rounded off by the double-cross keg turner (INNOKEG PM-DW), the keg constant turner (INNOKEG PM-SW) which turns all kegs 180 degrees after filling, and the keg control turner (INNOKEG PM-KW).

Inspection technology (INNOCHECK): empty bottle inspectors: the INNOCHECK LF product line from KHS offers a wide variety of state-of-the-art devices and machines for inspecting returnable glass or PET packaging. Capacities range from 36,000 to 72,000 bottles per hour. High-tech camera technology and tried and tested sensory testing systems, among others, are implemented for the following methods of inspection: bottle height checking, sealing surface, IR residual liquids check, inner side walls, camera base. Foreign substance inspectors: the INNOCHECK FS is a highly dependable foreign substance inspector for inspecting PET multi-use bottles against contamination with taste and health affecting materials. The inspector has a low error return rate and a strong recognition rate and is resistant to parameter changes such as temperature fluctuation, air humidity and unclean air. The INNOCHECK FS operates with a velocity of 50,000 bottles per hour. The filling level checking system: the INNOCHECK FT 50 filling level checking system is available for checking the filling level of bottles and cans. Password-protected recording 20 different types of containers is part of the standard equipment as well as production statistics, counter readings for overfilling or underfilling, and diagnostic functions. The INNOCHECK FT 50 is easy to operate and features dependable filling level detection and a standardized link to reject systems. Crate checking: the INNOCHECK program offers various solutions for checking and detecting defective cartons, containers in cartons, shrink-wrap packaging, and plastic or metal closures. The simple and clearly arranged method of operation guarantees trouble-free machine performance for a multitude of applications.

Filling technology (INNOFILL) comprising: overpressure fillers—KHS offers several overpressure fillers: (INNOFILL EM, ER, EV, DR) equipped with mechanical and computer-controlled filling valves for filling carbonated beverages, particularly soft drinks and mineral water, in glass and plastic containers. A special feature of the INNOFILL EV is the volumetric recording of the filling volume using electromagnetic inductive flowmetering (MID). Capacities range from 5,000 to 80,000 bottles per hour, depending on the type of machine and the container to be filled. Normal pressure fillers: the KHS product program includes the INNOFILL NR double-chamber normal pressure bottle fillers. Equipped with computer-controlled filling valves, this filler is ideal for filling beverages in glass and plastic containers. The INNOFILL NR is capable of filling 6,000 to 70,000 0.7-liter bottles per hour. Can fillers: the INNOFILL product line for can filling is particularly suitable for filling beer, soft drinks, mixed beverages (carbonated and non-carbonated) as well as pulp and non-pulp juices (also hot filling). The complex filler program guarantees high performance standards and offers a host of engineering highlights, for instance, pressure-less filling of non-carbonated products. Or the extremely fast central filling level correction which can also be optionally used automatically during production operation. Particularly worthy of note are the filling temperatures; the approximate temperature for beer is 16 degrees Celsius, 20 degrees Celsius for soft drinks, and 85 degrees Celsius for juices. Rinsers: the KHS INNOFILL program includes two rinsers for single or double rinsing or blowing out of glass and plastic containers of various sizes and shapes. The EMZ/ZM rinser is a universal mechanical rinser with a capacity range from 10,000 to 75,000 bottles per hour. The universal computercontrolled triple-chamber DR rinser has the same capacity range. KHS offers the fully automatic DW can rinser designed for rinsing empty cans, which, depending on the configuration, is capable of outputs from 18,000 to 160,000 cans per hour.

Pasteurizing technology (INNOPAS): KHS pasteurizers are ideal for heating glass, plastic, and metal containers. Beverages and foods such as beer, vegetable juices, fruit juices, fruit juice drinks, and other products are thus biologically preserved. These machines operate fully automatically using the continuous flow processes to gradually heat, pasteurize, and recool the product to be pasteurized during the treatment period. Depending on the equipment installed, the pasteurizers are capable of outputs ranging from 10,000 to 200,000 containers per hour. Heaters: the INNOPAS W, equipped with a continuously running conveyor belt, is a fully automatic machine for warming up cold-filled beverages or food products. The heater's conveyor belt can be made of plastic for can and plastic bottle processing or stainless steel for glass bottle processing. Capacities range from 5,000 to 120,000 container per hour. Recoolers: the INNOPAS K, equipped with a continuously running conveyor belt, is a fully automatic machine for re-cooling hotfilled beverages or food products. Depending on their size, the re-coolers are designed as compact or segment-type machines. You may choose between plastic and stainless steel chain belts as a conveyor medium. Capacities range from 5,000 to 50,000 containers per hour.

Labelling technology (INNOKET): cold glue labeler—the INNOKET KL labeler is designed for cold glue processing of body, neck, back, neck ring, diagonal ribbon, and safety seal labels as well as aluminum foil. The product line is comprised of five different basic models which fulfill a host of customer capacity and equipment requirements through application-specific modular design (capacity range: 20,000 to 66,000 container per hour). The INNOKET KL can be optionally equipped with MIS, the Machine Information System. Hot-melt labelers: the INNOKET HL product line was developed especially for wrap-around labelling of glass and PET bottles, and cans. High-performance labelers for hot melt processing. The gluing width is easily adapted to the various container material properties. Adhesives are gently treated by the "three-phase heat-up" (capacity range up to 45,000 per hour). Roll-fed labelers: the INNOKET RF is a highperformance labeler designed for processing paper or foil labels even as partial or wrap-around labels. The IN~OKET RF offers dependable processing at capacities ranging up to 48,000 cans, glass or plastic bottles per hour, regardless if polypropylene, polyethylene, polystyrene or paper labels are used.

Packing technology (INNOPACK): robots: KHS builds folding arm or one column robots for the application in the packing and palletizing.area. Four axes folding arm robots are used particularly, where low performance and high flexibility are in demand by changing position pictures or applications. Three-axes column robots are ideal by their high-dynamic servo-drives, if short cycle times, high pay load and high throughput rates are required. Cyclic packer: Two models of the fully automatic INNOPACK cyclic packer product line are available: CT and GT. Both are ideal for packing or unpacking bottles, jars, cans, multi packs in plastic crates, carton, or trays. The cyclic packer's extremely efficient operation achieves high packing performance while requiring a minimum amount of space (INNOPACK CT: 500 to 1,900 packagings per hour, INNOPACK GT: 1,000 to 7,000 module crates per hour). Two INNOPACK CT models are available: the short stroke machine (packing movement) for plastic crate processing and the long stroke version (Packing movement) for folding box processing. Multipacker: the fully automatic operation of the INNOPACK GTM multipacker is used for combined packing-of bulk containers in plastic crates and cartons or for placing multipacks in plastic crates, cartons, and trays. An outstanding feature of this machine is its horizontally moveable gripper traverse. Packing heads can be equipped as required with a gripping hook system, a vacuum gripping system, or a packing bell system, as well as a horizontally operating swivelling system. Rotary packer: the INNOPACK CR rotary packer is a continuously operating packing and unpacking machine designed for packing plastic crates or cartons (2,400 to 8,100 module crates per hour). It is capable of handling a multitude of tasks and its complex equipment makes it usable in all capacity ranges throughout the beverage industry. Two basic models of the rotary packer are available: size 1 for single and double-track crate conveyors, size 2 exclusively for double-track crate conveyors. Bottle aligner: KHS has developed a single and double-track, fully automatic INNOPACK FA series bottle alignment machine for integration in the packaging conveyor system for proper product presentation. The machine capacity is maximum 96,000 bottles per hour for a 6-second work cycle. Palletizing technology (INNOPAL): palletizers: the INNOPAL palletizer concept is state-of-the-art and stands for high dependability, economy, and flexibility. Its modular design and versatility defined for customer advantage provide the ideal solution for each type of application. The INNOPAL PM and PL product lines offer machines and systems which can be equipped with a wide variety of loading heads. Nominal capacities range from 120 to 600 layers per hour depending on the model (single or double-column). Depalletizers: INNOPAL depalletizers are designed for the mid and upper capacity range. These machines depalletize by pushing jars, cans, glass or plastic bottles (also Petaloidbase bottles), even of various heights and diameters, layer by layer from pallets of the same size. Two models are available depending on the capacity and system configuration: the singlecolumn, high-level packaging discharge INNOPAL AM with a capacity of 240 to 400 layers per hour and the double-column, low-level packaging discharge version of the INNOPAL AL with a capacity of up to 200 layers per hour. Crate stacker: the fully automatic plastic crate stackers of the INNOPAL KM product line are used as block buffer magazines if filling lines require buffer capacities exceeding 1,000 crates. They can be designed for a capacity of up to 10,000 crates. Pallet stackers: the fully automatic pallet stackers of the INNOPAL product line, stack or unstack pallets, kegs, crates, and with boxes to or from two or three-layers of pallets. Even various size pallets can be processed. Capacities range from 80 to 150 pallets per hour, depending on the model. Vertical pallet conveyors: the vertical pallet conveyors of the INNOPAL FM and FL product lines are fully automatic conveyor lines which link conveyor segments between floors or different levels. They are available in two models: INNOPAL FM. Singlecolumn vertical conveyor ideal for conveying heights of up to 12 meters and loads of up to 1,000 kg. INNOPAL FL. Double-column, portal, vertical conveyor equipped with two lifting chains. The conveying height of the INNOPAL FL is up to 20 meters and the maximum load is 2,500 kg (two-space version).

Attendant equipment and systems such as plant information system (INNOLINE): the INNOLINE program includes conveyors designed for glass and PET bottles, and round, oval or rectangular shaped cans. In their capacity as linking elements between the processing stations, the container conveyors have a considerable effect on the function and efficiency of the overall system. For this reason, all models have the following distinguishing features; highly economical through the use of mechanical and electrical system of building blocks, optimum selection of materials, stable and sturdy design, easy to service through excellent accessibility, easy to clean, product-oriented conveyor regulation and controls, and low-pressure and low-noise conveying through SOFTSTEP MODULE. Pallet conveyors: KHS offers a conveyor system comprised of standard elements capable of performing all the horizontal and vertical level movements necessary for in-feeding and discharging pallets. The building block type design permits coupling of all units in order to simply and clearly perform the most varied of conveying tasks. The INNOLINE program includes horizontal pallet conveyors (equipped with roller or chain conveyors), and vertically conveying pallet magazines, as well as pallet checking systems. Crate magazines: the INNOLINE KMZ is an empty crate row magazine. Available are single or double-track versions. The storage capacity depends on the length and the number of rows. The single-track version has a capacity for 280 to 570 module crates and the double-track version 560 to 1140 module crates. The fully automatic operation of the crate row magazines solve the problem of adequate buffer space between craters and decraters. In order to be able to optimize plant productivity, one should know exactly where the weak points are. This is the purpose and the job of the INNOLINE Plant Information System (AIS). The AIS system, installed on a PC, handles the task of evaluating all production and disruption data collected, making it thus possible for plant operators to monitor the current status of the filling line at any time. All AIS information can also be integrated in other internal company DP systems.

All of the above website information is hereby incorporated by reference as if set forth in its entirety herein.

Examples of bottling systems, which may be used in embodiments of the present invention, may be found in the following U.S. Patents, which are hereby incorporated by reference, as if set forth in their entirety herein include U.S. Pat. No. 5,558,138 issued to Stock, et al. on Sep. 24, 1996 and entitled "Process and apparatus for cleaning container handling machines such as beverage can filling machines"; U.S. Pat. No. 5,634,500 issued to Clusserath et al. on Jun. 3, 1997 and entitled "Method for bottling a liquid in bottles or similar containers"; and U.S. Pat. No. 5,713,403 issued to Clusserath et al. on Feb. 3, 1998 and entitled "Method and system for filling containers with a liquid filling product, and filling machine and labelling device for use with this method or system". All of the above U.S. patent documents in this paragraph are assigned to KHS Maschinen—und Anlagenbau Aktiengesellechaft of Dortmund, Federal Republic of Germany.

Examples of container labelling and/or filling machines and components thereof and/or accessories therefor may be found in the following documents, which are hereby incorporated by reference, as if set forth in their entirety herein include U.S. Pat. No. 4,911,285 issued to Rogall, et al. on Mar. 27, 1990 and entitled "Drive for a rotary plate in a labelling machine for bottles"; U.S. Pat. No. 4,944,830 issued to Zodrow et al. on Jul. 31, 1990 and entitled "Machine for labelling bottles"; U.S. Pat. No. 4,950,350 issued to Zodrow et al on Aug. 21, 1990 and entitled "Machine for labelling bottles or the like"; U.S. Pat. No. 4,976,803 issued to Tomashauser et al. on Dec. 11, 1990 and entitled "Apparatus for pressing foil on containers, such as on the tops and the necks of bottles or the like"; U.S. Pat. No. 4,981,547 issued to Zodrow et al. on Jan. 1, 1991 and entitled "Mounting and drive coupling for the extracting element support of a labelling station for a labelling machine for containers and similar objects"; U.S. Pat. No. 5,004,518 issued to Zodrow on Apr. 2, 1991 and entitled "Labelling machine for objects such as bottles or the like"; U.S. Pat. No. 5,017,261 issued to Zodrow et al. on May 21, 1991 and entitled "Labelling machine for objects such as bottles or the like"; U.S. Pat. No. 5,062,917 issued to Zodrow et al. on Nov. 5, 1991 and entitled "Support element for the followers of a cam drive of a drive mechanism and a labelling station equipped with a support element"; U.S. Pat. No. 5,062,918 issued to Zodrow on Nov. 5, 1991 and entitled "Glue segments which can be attachable to a drive shaft of a labelling machine"; U.S. Pat. No. 5,075,123 issued to Schwinghammer on Dec. 24, 1991 and entitled "Process and apparatus for removing alcohol from beverages"; U.S. Pat. No. 5,078,826 issued to Rogall on Jan. 7, 1992 and entitled "Labelling machine for the labelling of containers"; U.S. Pat. No. 5,087,317 issued to Rogall on Feb. 11, 1992 and entitled "Labelling machines for the labelling of containers"; U.S. Pat. No. 5,110,402 issued Zodrow et al. on May 5, 1992 and entitled "Labelling machine for labelling containers such as bottles having a labelling box for a stack of labels in a labelling station"; U.S. Pat. No. 5,129,984 issued to Tomashauser et al on Jul. 14, 1992 and entitled "Machine for wrapping foil about the tops and necks of bottles"; U.S. Pat. No. 5,167,755 issued Zodrow et al. on Dec. 1, 1992 and entitled "Adhesive scraper which can be adjusted in relation to an adhesive roller in a labelling machine"; U.S. Pat. No. 5,174,851 issued Zodrow et al. on Dec. 29, 1992 and entitled "Labelling machine for labelling containers, such as bottles"; U.S. Pat. No. 5,185,053 issued to Tomashauser et al. on Feb. 9, 1993 and entitled "Brushing Station for a labelling machine for labelling bottles and the like"; U.S. Pat. No. 5,217,538 issued Buchholz et al. on Jun. 8, 1993 and entitled "Apparatus and related method for the removal of labels and foil tags adhering to containers, in particular, to bottles"; U.S. Pat. No. 5,227,005 issued to Zodrow et al. on Jul. 13, 1993 and entitled "Labelling station for labelling objects, such as bottles"; U.S. Pat. No. 5,413,153 issued to Zwilling et al. on May 9, 1995 and entitled "Container filling machine for filling open-top containers, and a filler valve therefor"; and U.S. Pat. No. 5,569,353 issued to Zodrow on Oct. 29, 1996 and entitled "Labelling machine and apparatus for the automatic loading of the main magazine of a labelling machine, and a supply magazine which can be used in such an apparatus". All of the above U.S. patent documents in this paragraph are assigned to KHS Maschinen— und Anlagenbau Aktiengesellechaft of Dortmund, Federal Republic of Germany.

Some additional examples of container filling systems, valves or methods and their components which may be incorporated in an embodiment of the present invention may be found in U.S. Pat. No. 5,377,726 issued to Clusserath on Jan. 3, 1995 and entitled "Arrangement for filling bottles or similar containers"; U.S. Pat. No. 5,402,833 issued to Clusserath on Apr. 4, 1995 and entitled "Apparatus for filling bottles or similar containers"; U.S. Pat. No. 5,425,402 issued to Pringle on Jun. 20, 1995 and entitled "Bottling system with mass filling and capping arrays"; U.S. Pat. No. 5,445,194 issued to Clusserath on Aug. 29, 1995 and entitled "Filling element for filling machines for dispensing a liquid filling material into containers"; and U.S. Pat. No. 5,450,882 issued to Gragun on Sep. 19, 1995 and entitled "Beverage dispensing apparatus and process", all of these U.S. patents being hereby expressly incorporated by reference as if set forth in their entirety herein.

Some further examples of container filling systems, valves or methods and their components which may possibly be incorporated into the present invention are to be found in U.S. Pat. No. 5,190,084 issued to Diehl et al. on Mar. 2, 1993 and entitled "Filling element for filling machines for dispensing liquid"; U.S. Pat. No. 5,195,331 issued to Zimmern et al. on Mar. 23, 1993 and entitled "Method of using a thermal expansion valve device, evaporator and flow control means assembly and refrigerating machine"; U.S. Pat. No. 5,209,274 issued to LaWarre, Sr. on May 11, 1993 and entitled "Filling valve apparatus having shortened vent tube"; U.S. Pat. No. 5,217,680 issued to Koshiishi et al. an Jun. 8, 1993 and entitled "Liquid filling method for a high-temperature and high-pressure vessel and apparatus therefor"; and U.S. Pat. No. 5,241,996 issued to Werner et al. and entitled "Apparatus for filling liquid into containers", all of these U.S. patents being hereby expressly incorporated by reference as if set forth in their entirety herein.

Some yet further additional examples of container filling systems, apparatus or methods and their components which may possibly be incorporated into the present invention are to be found in U.S. Pat. No. 3,960,066 issued to LaRocco et al. on Jun. 1, 1976 and entitled "Beverage preparation apparatus"; U.S. Pat. No. 4,103,721 issued to Noguchi on Aug. 1, 1978 and entitled "Method and apparatus for bottling beer"; U.S. Pat. No. 4,124,043 issued to Noguchi on Nov. 7, 1978 and entitled "Method and apparatus for bottling"; U.S. Pat. No. 4,135,699 issued to Petzsch et al. on Jan. 23, 1979 and entitled "Control valve for gaseous and liquid media"; U.S. Pat. No. 4,146,065 issued to Borstelmann on Mar. 27, 1979 and entitled "Method and machine for charging liquid into containers"; U.S. Pat. No. 4,171,714 issued to Knabe et al. on Oct. 23, 1979 and entitled "Filling machine for charging containers with a liquid"; U.S. Pat. No. 4,549,272 issued to Hagan et al. on Oct. 22, 1985 and entitled "Apparatus for filling containers with prescribed quantity of product by weight"; U.S. Pat. No. 4,599,239 issued to Wieland et al. on Jul. 8, 1986 and entitled "Method of preparing nonalcoholic beverages starting with a deaerated low sugar concentration base"; U.S. Pat. No. 5,058,632 issued to Lawarre, Sr. et al. on Oct. 22, 1991 and entitled "Filling valve apparatus"; U.S. Pat. No. 5,318,078 issued to Hantmann on Jun. 7, 1994 and entitled "Process for bottling beverages"; U.S. Pat. No. 5,365,771 issued to Gysi et al. and entitled "Process and apparatus for testing bottles for contamination"; U.S. Pat. No. 5,409,545 issued to Levey et al. on Apr. 25, 1995 and entitled "Apparatus and method for cleaning containers"; U.S. Pat. No. 5,458,166 issued to Kronseder on Oct. 17, 1995 and entitled "Cleansing system for a container treating machine"; U.S. Pat. No. 5,566,695 issued to Levey et al. and entitled "Modular apparatus and method for cleaning containers"; U.S. Pat. No. 5,689,932 issued to Peronek et al. on Nov. 25, 1997 and entitled "Quick change method and apparatus for filling and capping machines"; U.S. Pat. No. 5,732,528 issued to Peronek et al. and entitled "Container guide for filling and capping machine"; U.S. Pat. No. 5,778,633 issued to Sweeny on Jul. 14, 1998 and entitled "Quick change ledge support assembly for filling and capping machines"; and U.S. Pat. No. 6,058,985 issued to Petri et al. on May 9, 2000 and entitled "Bottling machine with set-up table and a set-up table for a bottling machine and a set-up table for a bottle handling machine", all of these U.S. patents being hereby expressly incorporated by reference as if set forth in their entirety herein.

Some additional examples of methods and apparatuses for closing bottles and containers and their components which may possibly be incorporated in an embodiment of the present invention may be found in U.S. Pat. No. 5,398,485 issued to Osifchin on Mar. 21, 1995 and entitled "Bottle support mechanism for a capping machine"; U.S. Pat. No. 5,402,623 issued to Ahlers on Apr. 4, 1995 and entitled "Method and apparatus for closing bottles"; U.S. Pat. No. 5,419,094 issued to Vander Bush, Jr. et al. on May 30, 1995 and entitled "Constant speed spindles for rotary capping machine"; U.S. Pat. No. 5,425,402 issued to Pringle on Jun. 20, 1995 and entitled "Bottling system with mass filling and capping arrays"; U.S. Pat. No. 5,447,246 issued to Finke on Sep. 5, 1995 and entitled "Methods and combinations for sealing corked bottles"; U.S. Pat. No. 5,449,080 issued to Finke on Sep. 12, 1995 and entitled "Methods and combinations for sealing corked bottles"; and U.S. Pat. No. 5,473,855 issued to Hidding et al. and entitled "System for installing closures on containers", all of these U.S. patents being hereby expressly incorporated by reference as if set forth in their entirety herein.

Some further examples of methods and apparatuses for filling containers and their components which may possibly be incorporated in an embodiment of the present invention may be found in U.S. Pat. No. 3,946,770 issued to Trinne et al. on Mar. 30, 1976 and entitled "Bottle filling means and method"; U.S. Pat. No. 4136,719 issued to Kronseder et al. on Jan. 30, 1979 and entitled "Method and device for cleaning bottle filling machines and the like"; U.S. Pat. No. 4,446,673 issued to Desthieux on May 8, 1984 and entitled "Bottle-filling method and device"; U.S. Pat. No. 4,467,846 issued to Croser on Aug. 28, 1984 and entitled "Bottle filling device"; U.S. Pat. No. 4,653,249 issued to Simonazzi on Mar. 31, 1987 and entitled "Telescopic filling adapter for bottle filling machines"; U.S. Pat. No. 4,911,21 issued to Burton on Mar. 27, 1990 and entitled "Bottle filling device"; U.S. Pat. No. 4,967,813 issued to Ponvianne et al. on Nov. 6, 1990 and entitled "Bottle filling machine and filling head therefor"; U.S. Pat. No. 4,987,726 issued to Petho et al. on Jan. 29, 1991 and entitled "Bottle filling and sealing apparatus"; U.S. Pat. No. 5,191,742 issued to Jones on Mar. 9, 1993 and entitled "Fluidized bed bottle filling system"; U.S. Pat. No. 5,454,421 issued to Kerger et al. On Oct. 3, 1995 and entitled "Device for filling and emptying a gas bottle"; U.S. Pat. No. 5,494,086 issued to McBrady et al. on Feb. 27, 1996 and entitled "Bottle filling machine", U.S. Pat. No. 5,533,552 issued to Ahlers on Jul. 9, 1996 and entitled "Bottle filling machine and a cleansing system accessory including an operator therefor"; and U.S. Pat. No. 5,582,223 issued to Weh et al. on Dec. 10, 1996 and entitled "Filling apparatus for gas bottle valves", all of these U.S. patents being hereby expressly incorporated by reference as if set forth in their entirety herein.

Examples of rotary position sensors and rotary position indicators, components thereof, and components associated therewith, which may be utilized in accordance with the embodiments of the present invention, may be found in the following U.S. Patents: U.S. Pat. No. 4,360,889 issued to Liedtke on Nov. 23, 1982 and entitled "Rotary position indicating circuit"; U.S. Pat. No. 4,458,893 issued to Ruh on Jul. 10, 1984 and entitled "Drive for sheet feeder in printing press"; U.S. Pat. No. 4,581,993 issued to Schoneberger on Apr. 15, 1986 and entitled "Device for a printing press comprising a plate cylinder and/or blanket cylinder"; U.S. Pat. No. 4,841,246 issued to Juds et al. on Jun. 20, 1989 and entitled "Multiturn shaft position sensor having magnet movable with nonrotating linear moving unit"; U.S. Pat. No. 4,899,643 issued to Hvilsted et al. on Feb. 13, 1990 and entitled "Hydraulic cylinder comprising at least one electric position indicator"; U.S. Pat. No. 5,222,457 issued to Friedrich on Jun. 6, 1993 and entitled "Indicator for rotary positioner"; U.S. Pat. No. 5,396,139 issued to Surmely et al. on Mar. 7, 1995 and entitled "Polyphase electromagnetic transducer having a multipolar permanent magnet"; U.S. Pat. No. 5,419,195 to Quinn on May 30, 1995 and entitled "Ultrasonic booted head probe for motor bore inspection"; U.S. Pat. No. 5,424,632 issued to Montagu on Jun. 13, 1995 and entitled "Moving magnet optical scanner with novel rotor design"; U.S. Pat. No. 5,433,118 issued to Castillo on Jul. 18, 1995 and entitled "Magnetic turbine rotor for low flow fluid meter"; U.S. Pat. No. 5,442,329 issued to Ghosh et al. on Aug. 15, 1995 and entitled "Waveguide rotary joint and mode transducer structure therefor"; and U.S. Pat. No. 5,444,368 issued to Horber on Aug. 22, 1995 and entitled "Differential reactance permanent magnet position transducer", all of these U.S. patents being hereby expressly incorporated by reference as if set forth in their entirety herein.

Examples of filling machines that utilize electronic control devices to control various portions of a filling or bottling process and which may possibly be utilized in connection with the present invention are to be found in U.S. Pat. No. 4,821,921 issued to Cartwright et al. on Apr. 18, 1989 and entitled "Liquid dispensing apparatus"; U.S. Pat. No. 5,056,511 issued to Ronge on Oct. 15, 1991 and entitled "Method and apparatus for compressing, atomizing, and spraying liquid substances"; U.S. Pat. No. 5,273,082 issued to Paasche et al. on May 27, 1992 and entitled "Method and apparatus for filling containers"; and U.S. Pat. No. 5,301,488 issued to Ruhl et al. on Nov. 6, 1992 and entitled "Programmable filling and capping machine", all of these U.S. patents being hereby expressly incorporated by reference as if set forth in their entirety herein.

Rotary mechanical devices relating to bottling are to be found in U.S. Pat. No. 4,976,803 issued to Tomashauser et al. on Dec. 11, 1990 and entitled "Apparatus for pressing foil on containers, such as on the tops and the necks of bottles or the like", also referred to above; U.S. Pat. No. 5,087,317 issued to Rogall on Feb. 11, 1992 and entitled "Labelling machine for the labelling of containers", also referred to above; U.S. Pat. No. 5,174,851 issued to Zodrow et al. on Dec. 29, 1992 and entitled Labelling machine for labelling containers, such as bottles", also referred to above; U.S. Pat. No. 5,185,053 issued to Tomashauser et al. on Feb. 9, 1993 and entitled "Brushing station for a labelling machine for labelling bottles and the like", also referred to above; U.S. Pat. No. 5,217,538 issued to Buchholz et al. on Jun. 8, 1993 and entitled "Apparatus and related method for the removal of labels and foil tags adhering to containers, in particular, to bottles", also referred to above; and U.S. Pat. No. 5,219,405 issued to Weiss on Jun. 15, 1993 and entitled "Continuously operating rotational bottle filling installation", and all of these U.S. patents being hereby expressly incorporated by reference as if set forth in their entirety herein.

Examples of capping devices which may possibly be incorporated into the present invention are to be found in U.S. Pat. No. 4,939,890 issued to Peronek et al. on Apr. 14, 1989 and entitled "Anti-rotation method and apparatus for bottle capping machines"; U.S. Pat. No. 5,150,558 issued to Bernhard on Jul. 5, 1991 and entitled "Closing mechanism for a capping machine"; U.S. Pat. No. 5,157,897 issued to McKee et al. on Oct. 27, 1992 and entitled-"Rotary capping machine"; and U.S. Pat. No. 5,220,767 issued to de Santana on Jun. 22, 1993 and entitled "Device for applying a cap and seal to the mouth of a bottle whereon an interference boss is provided for said seal", all of these U.S. patents being hereby expressly incorporated by reference herein.

An example of an electric probe utilized in connection with a bottle filling process which may be incorporated into the present invention is to be found in U.S. Pat. No. 5,190,084 issued to Diehl et al. on May 3, 1991 and entitled "Filling element for filling machines for dispensing liquid", which U.S. patent is hereby expressly incorporated by reference as if set forth in its entirety herein.

Other examples of liquid level probes which may be incorporated into the present invention are to be found in U.S. Pat. No. 4,903,530 issued to Hull on Dec. 8, 1988 and entitled "Liquid level sensing system"; U.S. Pat. No. 4,908,783 issued to Maier on Apr. 28, 1987 and entitled "Apparatus and method for determining liquid levels"; and U.S. Pat. No. 4,921,129 issued on Jul. 11, 1988 to Jones et al. and entitled "Liquid dispensing module", all of these U.S. patents being hereby expressly incorporated by reference as if set forth in their entirety herein.

Some example computer systems and methods and their components which may possibly be incorporated in an embodiment of the present invention are to be found in U.S. Pat. No. 5,379,428 issued to Belo on Jan. 3, 1995 and entitled "Hardware process scheduler and processor interrupter for parallel processing computer systems"; U.S. Pat. No. 5,390,301 issued to Scherf on Feb. 14, 1995 and entitled "Method and apparatus for communicating device-specific information between a device driver and an operating system in a computer system"; U.S. Pat. No. 5,398,333 issued to Schieve et al. on Mar. 14, 1995 and entitled "Personal computer employing reset button to enter ROM-based diagnostics"; U.S. Pat. No. 5,404,544 issued to Crayford on Apr. 4, 1995 and entitled "System for periodically transmitting signal to/from sleeping node identifying its existence to a network and awakening the sleeping node responding to received instruction"; U.S. Pat. No. 5,418,942 issued to Krawchuk et al. On May 23, 1995 and entitled "System and method for storing and managing information"; U.S. Pat. No. 5,428,790 issued to Harper et al. on Jun. 27, 1995 and entitled "Computer power management system"; and U.S. Pat. No. 5,479,355 issued to Hyduke on Dec. 26, 1995 and entitled "System and method for a closed loop operation of schematic designs with electrical hardware", all of these U.S. patents being hereby expressly incorporated by reference as if set forth in their entirety herein.

Some examples of switches or levers, or components thereof, which may possibly be incorporated in an embodiment of the present invention are to be found in U.S. Pat. No. 5,392,895 issued to Sorensen on Feb. 28, 1995 and entitled "Transfer unit"; U.S. Pat. No. 5,404,992 issued to Robu et al. on Apr. 11, 1995 and entitled "Suspension conveyor system"; U.S. Pat. No. 5,438,911 issued to Fiedler et al. on Aug. 8, 1995 and entitled "Control cylinder for pneumatic control devices with signal switches"; U.S. Pat. No. 5,440,289 issued to Riordan on Aug. 8, 1995 and entitled "Combined alarm system and window covering assembly"; and U.S. Pat. No. 5,462,245 issued to Durchschlag and entitled "Apparatus for locking moveable switch parts", all of these U.S. patents being hereby expressly incorporated by reference as if set forth in their entirety herein.

Some examples of sensors and switches which may possibly be incorporated in an embodiment of the invention are to be found in U.S. Pat. No. 5,378,865 issued to Reneau on Jan. 3, 1995 and entitled "Multi-directional shock sensor"; U.S. Pat. No. 5,379,023 issued to Dalton on Jan. 3, 1995 and entitled "Alarm system"; U.S. Pat. No. 5,408,132 issued to Fericeau et al. on Apr. 18, 1995 and entitled "Proximity switch operating in a noncontacting manner"; U.S. Pat. No. 5,428,253 issued to Ogata et al. on Jun. 27, 1995 and entitled "Proximity switch"; U.S. Pat. No. 5,430,421 issued to Bornand et al. on Jul. 4, 1995 and entitled "Reed contactor and process of fabricating suspended tridimensional metallic microstructure"; U.S. Pat. No. 5,442,150 issued to Ipcinski on Aug. 15, 1995 and entitled "Piezo electric switch"; U.S. Pat. No. 5,444,295 issued to Lake et al. On Aug. 22, 1995 and entitled "Linear dual switch module"; U.S. Pat. No. 5,453,589 issued to Mayer on Sep. 26, 1995 and entitled "Microswitch with non-enlarging, sealed electrical connections"; and U.S. Pat. No. 5,453,590 issued to Mayer on Sep. 26, 1995 and entitled "Bistable microswitch", all of these U.S. patents being hereby expressly incorporated by reference as if set forth in their entirety herein.

Some examples of pressure sensors which may possibly be incorporated in an embodiment of the present invention are to be found in U.S. Pat. No. 4,703,657 issued to Hirama et al. on Nov. 3, 1987 and entitled "Gas pressure sensor"; U.S. Pat. No. 4,812,801 issued to Halvis et al. on Mar. 14, 1989 and entitled "Solid state gas pressure sensor";.U.S. Pat. No. 5,597,020 issued to Miller et al. on Jan. 28, 1997 and entitled "Method and apparatus for dispensing natural gas with pressure calibration"; U.S. Pat. No. 5,763,762 issued to Sweeney, Jr. on Jun. 9, 1998 and entitled "Total dissolved gas pressure sensor, replaceable collector module and process"; and U.S. Pat. No. 5,925,823 issued to Buehler et al. on Jul. 20 1999 and entitled "Alpha-particle gas-pressure sensor", all of these U.S. patents being hereby expressly incorporated by reference as if set forth in their entirety herein.

Some further examples of microcomputer control systems which may possibly be incorporated in an embodiment of the present invention are to be found in U.S. Pat. No. 5,530,515 issued to Saegusa et al. on Jun. 25, 1996 and entitled "Control system for an apparatus using a microprocessor"; U.S. Pat. No. 5,548,774 issued to Maurel on Aug. 20, 1996 and entitled "Microcomputer system providing time management enabling control and acquisition of data indicative of condition changes occurring at high speed"; U.S. Pat. No. 5,581,771 issued to Osakabe on Dec. 3, 1996 and entitled "Microcomputer having interrupt control circuit to determine priority level"; U.S. Pat. No. 5,610,749 issued to Mizoguchi et al. on Mar. 11, 1997 and entitled "Microcomputer control optical fiber transmission system"; U.S. Pat. No. 5,619,669 issued to Katsuta on Apr. 8, 1997 and entitled "Memory wait cycle control system for microcomputer"; U.S. Pat. No. 5,664,199 issued to Kuwahara on Sep. 2, 1997 and entitled "Microcomputer free from control of central processing unit (CPU) for receiving and writing instructions into memory independent of and during execution of CPU"; and U.S. Pat. No. 5,687,345 issued to Matsubara et al. on Nov. 11, 1997 and entitled "Microcomputer having CPU and built-in flash memory that is rewriteable under control of the CPU analyzing a command supplied from an external device", all of these U.S. patents being hereby expressly incorporated by reference as if set forth in their entirety herein.

Some further examples of microprocessor control systems which may possibly be incorporated in an embodiment of the present invention may be found in U.S. Pat. No. 4,202,035 issued to Lane on May 6, 1980 and entitled "Modulo addressing apparatus for use in a microprocessor"; U.S. Pat. No. 4,307,448 issued to Sattler on Dec. 22, 1981 and entitled "Method and a circuit arrangement for expanding the addressing capacity of a central unit, in particular of a microprocessor"; U.S. Pat. No. 4,419,727 issued to Holtey et al. on Dec. 6, 1983 and entitled "Hardware for extending microprocessor addressing capability"; U.S. Pat. No. 5,541,045 issued to Kromer, III on Sep. 10, 1985 and entitled "Microprocessor architecture employing efficient operand and instruction addressing"; U.S. Pat. No. 5,293,062 issued to Nakao on Mar. 8, 1994 and entitled FET nonvolatile memory with composite gate insulating layer"; U.S. Pat. No. 5,292,681 issued to Lee et al. on Mar. 8, 1994 and entitled "Method of processing a semiconductor wafer to form an array of nonvolatile memory devices employing floating gate transistors and peripheral area having CMOS transistors"; and U.S. Pat. No. 5,301,161 issued to Landgraf et al. on Apr. 5, 1994 and entitled "Circuitry for power supply voltage detection and system lockout for a nonvolatile memory", all of these U.S. patents being hereby expressly incorporated by reference as if set forth in their entirety herein.

Some examples of control valve apparatus and methods of operation thereof which possibly may be incorporated in an embodiment of the present invention may be found in U.S. Pat. No. 5,406,975 issued to Nakamichi et al. on Apr. 18, 1995 and entitled "Flow rate control valve"; U.S. Pat. No. 5,503,184 issued to Reinartz et al. on Apr. 2, 1996 and entitled "pressure control valve"; U.S. Pat. No. 5,706,849 issued to Uchida et al. on Jan. 13, 1998 and entitled "Flow control valve"; U.S. Pat. No. 5,975,115 issued to Schwegler et al. on Nov. 2, 1999 and entitled "Pressure control valve"; U.S. Pat. No. 6,142,445 issued to Kawaguchi et al. on Nov. 7, 2000 and entitled "Electromagnetic control valve"; U.S. Pat. No. 6,145,538 issued to Park on Nov. 14, 2000 and entitled "Flow control valve employing a step motor"; and U.S. Pat. No. 6,189,326 B1 issued to Tomatsu et al. on Feb. 20, 2001 and entitled "Pressure control valve", all of these U.S. patents being hereby expressly incorporated by reference as if set forth in their entirety herein.

Some examples of electric control valves which may possibly be used in an embodiment of the present invention may be found in U.S. Pat. No. 4,431,160 issued to Burt et al. on Feb. 14, 1984 and entitled "Electric control valve"; and U.S. Pat. No. 4,609,176 issued to Powers on Sep. 2, 1986 and entitled "Fluid flow control system with pulse driven electric control valve", all of these U.S. patents being hereby expressly incorporated by reference as if set forth in their entirety herein.

Some examples of pneumatic control valves which may possibly be incorporated in an embodiment of the present invention may be found in U.S. Pat. No. 4,302,057 issued to Durling on Nov. 24, 1981 and entitled "Pneumatic control valve"; U.S. Pat. No. 4,922,952 issued to Kemmler on May 8, 1990 and entitled "Pneumatic control valve"; U.S. Pat. No. 5,038,670 issued to Roe on Aug. 13, 1991 and entitled "Pneumatic control valve apparatus"; U.S. Pat. No. 5,218,994 issued to Jeschke on Jun. 15, 1993 and entitled "Arrangement having a pneumatic control valve with a housing closed on all sides"; and U.S. Pat. No. 5,918,631 issued to Weiler, Jr. et al. on Jul. 6, 1999 and entitled "Ballpoppet pneumatic control valve", all of these U.S. patents being hereby expressly incorporated by reference as if set forth in their entirety herein.

Some examples of vacuum pumps which possibly may be incorporated in an embodiment of the present intention may be found in U.S. Pat. No. 5,904,473 issued to Dahmlos et al. on May 18, 1999 and entitled "Vacuum pump"; U.S. Pat. No. 5,971,711 issued to Noji et al. on Oct. 26, 1999 and entitled "Vacuum pump control system"; U.S. Pat. No. 6,022,195 issued to Gaudet et al. on Feb. 8, 2000 and entitled "Electronically controlled vacuum pump with control module"; U.S. Pat. No. 6,056,510 issued to Miura et al. on May 2, 2000 and entitled "Multistage vacuum pump unit"; U.S. Pat. No. 6,123,516 issued to Burghard et al. on Sep. 26, 2000 and entitled "Vacuum pump"; U.S. Pat. No. 6,135,709 issued to Stones on Oct. 24, 2000 and entitled "Vacuum pump"; and U.S. Pat. No. 6,171,068 B1 issued to Greenberg on Jan. 9, 2001 and entitled "Vacuum pump", all of these U.S. patents being hereby expressly incorporated by reference as if set forth in their entirety herein.

Some examples of methods and apparatus for inert gas recovery in beverage filling or bottling features of which may possibly be incorporated in an embodiment of the present invention may be found in U.S. Pat. No. 4,390,048 issued to Zelder on Jun. 28, 1983 and entitled "Method and device for recovering an inert gas"; U.S. Pat. No. 4,637,438 issued to Weiss on Jan. 20, 1987 and entitled "Method and device for filling containers"; U.S. Pat. No. 4,693,054 issued to Spargo on Sep. 15, 1987 and entitled "Process for filling beer into containers"; U.S. Pat. No. 4,949,764 issued to Clusserath on Aug. 21, 1990 and entitled "Method for filling containers with carbonated liquid under counterpressure as dispensed having different filling characteristics by adjusting pressure differential without changing flow control mechanism"; U.S. Pat. No. 4,976,295 issued to Clusserath on Dec. 11, 1990 and entitled "Apparatus for filling containers with carbonated liquid under counterpressure as dispensed having different filling characteristics by adjusting pressure differential without changing flow control mechanism"; U.S. Pat. No. 5,016,684 issued to Clusserath on May 21, 1991 and entitled "Method and apparatus for dispensing carbonated liquids, especially beverages, into containers using counter pressure; and U.S. Pat. No. 5,329,963 issued to Jones et al. on Jul. 19, 1994 and entitled "Method of and apparatus for packaging a beverage in a container", all of these U.S. patents being hereby expressly incorporated by reference as if set forth in their entirety herein.

Some additional examples of counter pressure filling methods and apparatus features of which may possibly be used in an embodiment of the present invention may be found in U.S. Pat. No. 4,089,353 issued to Antonelli on May 16, 1978 and entitled "Filling valve for carbonated liquid bottling machines"; U.S. Pat. No. 5,273,084 issued to Monnig on Dec. 28, 1993 and entitled "Gas flow check valve for bottle filling device"; U.S. Pat. No. 5,884,677 issued to McKaughan on Mar. 23, 1999 and entitled "Beverage filling machine"; U.S. Pat. No. 5,924,462 issued to McKaughan on Jul. 20, 1999 and entitled "Beverage filling machine"; U.S. Pat. No. 6,076,567 issued to Naecker et al. on Jun. 20, 2000 and entitled "Filling machine assembly"; and U.S. Pat. No. 6,109,483 issued to Wilke et al. on Aug. 29, 2000 and entitled "Filling machine assembly having a movable vent tube", all of these U.S. patents being hereby expressly. incorporated by reference as if set forth in their entirety herein.

The details in the patents, patent applications and publications may be considered to be incorporable, at applicants' option, into the claims during prosecution as further limitations in the claims to patentably distinguish any amended claims from any applied prior art.

Some further examples of bottling systems and features, which may possibly be used in embodiments of the present invention, which are incorporated by reference, as if set forth in their entirety herein, are to be found in U.S. patent application Ser. No. 08/238,613 filed on May 5, 1994 entitled "Apparatus for sorting bottles or similar containers", having inventors Christoph WEISSENFELS and Manfred LONNIG, which corresponds to Federal Republic of Germany patent application No. P 43 15 038, filed May 6, 1993, which corresponds to DE-OS 43 15 038 and DE-PS 43 15 038; U.S. patent application Serial No. 08/246,605 filed on May 20, 1994 entitled "Method and arrangement for converting a single-row stream of containers into a multi-row stream of containers", having inventor Heinz-Jurgen SCHERER, which corresponds to Federal Republic of Germany patent application No. P 43 17 069 filed on May 21, 1993, which corresponds to DE-OS 43 17 069 and DE-PS 43 17 069; U.S. patent application Ser. No. 08/372674 filed on Jan. 16, 1995 entitled "Apparatus for processing containers returned to food and beverage producers for the refilling of the containers", having inventor Karl HEIDRICH, which corresponds to Federal Republic of Germany patent application No. P 42 23 427 filed on Jul. 16, 1992, which corresponds to DE-OS 42 23 427 and DE-PS 42 23 427, and International application No. PCT/DE93/00586 filed on Jul. 1, 1993, which corresponds to WO 94/02848; U.S. patent application Ser. No. 08/383,156 filed on Feb. 3, 1995 entitled "Apparatus for processing containers returned to food and beverage producers for the refilling of the containers, having inventors Rudiger STRAUCHMANN, Marten PETERS, and Hubert GAISBAUER, which corresponds to Federal Republic of Germany patent application No. P 42 25 984 filed on Aug. 6, 1992, which corresponds to DE-OS 42 25 984 and DE-PS 42 25 984, and International application No. PCT/DE93/00692 filed Aug. 4, 1993, which corresponds to WO 94/03287; all of the above U.S. patent documents in this paragraph are assigned to KHS Maschinen- und Anlagenbau Aktiengesellechaft of Dortmund, Federal Republic of Germany. U.S. patent application Ser. No. 09/282,975 filed on Mar. 31, 1999, having the inventor Herbert BERNHARD, with Attorney Docket No. NHL-HOL-39 and claiming priority from Federal Republic of Germany Patent Application No. 198 14 625.6 which was filed on Apr. 1, 1998, and DE-OS 198 14 625.6 and DE-PS 198 14 625.6, are hereby incorporated by reference as if set forth in their entirety herein.

U.S. patent application Ser. No. 09/299,497 filed on Apr. 26, 1999, having the inventor Ludwig CLUSSERATH, with Attorney Docket No. NHL-HOL-40 and claiming priority from Federal Republic of Germany Patent Application No. 198 18 761.0 which was filed on Apr. 27, 1998, and DE-OS 198 18 761.0 and DE-PS 198 18 761.0, are hereby incorporated by reference as if set forth in their entirety herein.

U.S. patent application Ser. No. 09/300,015 filed on Apr. 27, 1999, having the inventor Ludwig CLUSSERATH, with Attorney Docket No. NHL-HOL-41 and claiming priority from Federal Republic of Germany Patent Application No. 198 18 762.9 which was filed on Apr. 27, 1998, and DE-OS 198 18 762.9 and DE-PS 198 18 762.9, are hereby incorporated by reference as if set forth in their entirety herein.

U.S. patent application Ser. No. 09/373,132 filed on Aug. 12, 1999, having the inventor Ludwig CLUSSERATH, with Attorney Docket No. NHL-HOL-42 and claiming priority from Federal Republic of Germany Patent Application No. 198 36 500 which was filed on Apr. Aug. 12, 1998, and DE-OS 198 36 500 and DE-PS 198 36 500, are hereby incorporated by reference as if set forth in their entirety herein.

U.S. patent application Ser. No. 09/792,129 filed on Feb. 22, 2001, having inventors Ludwig CLUSSERATH and Manfred HARTEL and Attorney Docket No. NHL-HOL-50, and claiming priority from Federal Republic of Germany Patent Application No. 100 08 426, filed on Feb. 23, 2000, as well as their published equivalents, and other equivalents or corresponding applications,if any, in corresponding cases in the Federal Republic of Germany and elsewhere, and the references cited in any of the documents cited herein, are hereby incorporated by reference as if set forth in their entirety herein.

U.S. patent application Ser. No. 09/803,728 filed on Mar. 9, 2001, having inventors Siegmar SINDERMANN and Attorney Docket No. NHL-HOL-51, and claiming priority from Federal Republic of Germany Patent Application No. 100 11 653, filed on Mar. 10, 2000, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

This invention as described hereinabove in the context of the preferred embodiments is not to be taken as limited to all of the provided details thereof, since modifications and variations thereof may be made without departing from the spirit and scope of the invention.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A plant for filling containers, such as beverage bottles, with a liquid beverage with a filling machine, said filling machine comprising:

apparatus configured and disposed to move containers into said filling machine to permit filling of containers with a liquid beverage;

apparatus configured and disposed to withdraw containers filled with a liquid beverage from said filling machine;

a supply arrangement configured and disposed to contain a supply of liquid beverage with which the containers are to be filled;

a supply arrangement configured and disposed to contain a supply of protective gas to protect the liquid beverage in a filled container;

at least one filling element configured and disposed to sealingly engage with the containers during filling;

apparatus configured and disposed to introduce the liquid beverage into a container sealingly engaged with each said at least one filling element through each said at least one filling element into a container;

at least one supply passage for the protective gas, configured to be opened and closed, and disposed between said protective gas supply tank and the interior of a container sealingly engaged with each said at least one filling element;

conduit means configured and disposed to collect protective gas from a container filled with said protective gas upon the filling of a container with a liquid beverage;

a first evacuation system configured and disposed to remove air by pumping the air from the interior of a container sealingly engaged with each said at least one filling element;

apparatus configured and disposed to introduce the protective gas into a container sealingly engaged with each said at least one filling element subsequent to evacuation of the air from a container to pressurize a beverage container to a first pressure;

apparatus configured and disposed to introduce liquid beverage into a container subsequent to the introduction of the protective gas into a container;

said liquid beverage introducing apparatus comprising at least one supply passage for the liquid beverage configured to be disposed between said beverage supply tank and the interior of a container;

a second evacuation system configured and disposed to remove the introduced protective gas by pumping the introduced protective gas from the interior of a container;

said second evacuation system comprising an evacuation system being configured and disposed to be independent of said first, air, evacuation system;

apparatus configured and disposed to treat the removed protective gas to recover at least a substantial portion of protective gas from the removed protective gas;

apparatus to introduce the treated recovered protective gas into said protective gas supply arrangement; and control apparatus to control said filling machine.

2. The plant for filling containers according to claim 1, wherein:

said protective gas comprises carbon dioxide.

3. The plant for filling containers according to claim 2, wherein:

each said at least one filling element comprises a passage configured and disposed to pass the liquid beverage into a container sealingly engaged with each said at least one filling element;

each said at least one filling element comprises an arrangement configured and disposed to open said passage to permit a flow of liquid beverage into a container and configured and disposed to close said passage to terminate the flow of liquid beverage into a container.

4. The plant for filling containers according to claim 3, wherein:

said liquid beverage supply arrangement and said protective gas supply arrangement together comprise a reservoir;

said reservoir being configured and disposed to maintain a supply of carbon dioxide gas and a supply of said liquid beverage.

5. The plant for filling containers according to claim 4, wherein:

said conduit means comprises a conduit for conducting gas from a container;

said gas-conducting conduit being configured and disposed to be connected to said first evacuation system to remove air from a container and said gas-conducting conduit also being configured and disposed to be connected to said second evacuation system to remove carbon dioxide from a container;

said gas-conducting conduit being configured and disposed to remove in sequence both: air and carbon dioxide, from a container sealingly engaged with each said at least one filling element;

said first evacuation system comprises a first valve arrangement operatively connected to said control apparatus and to said gas-conducting conduit;

said first valve arrangement being configured and disposed to control the flow of air through said gas-conducting conduit from a container sealingly engaged with each said at least one filling element; and said second evacuation system comprises a second valve arrangement operatively connected to said control apparatus and said gas-conducting conduit;

said second valve arrangement being configured and disposed to control the flow of carbon dioxide gas through said gas-conducting conduit from a container sealingly engaged with each said at least one filling element.

6. The plant for filling containers according to claim 5, wherein:

said first, air, evacuation system comprises a first vacuum pump to remove air from a container; and said second, carbon dioxide, evacuation system comprises a second vacuum pump to remove carbon dioxide from a container.

7. The plant for filling containers according to claim 6; wherein:

said second pump is configured and disposed to remove carbon dioxide gas during filling of a container with liquid beverage.

8. The plant for filling containers according to claim 7; wherein:

said filling machine comprises a counter pressure filling machine.

9. A method of operating a plant for filling containers, such as beverage bottles, with a liquid beverage with a filling machine, said filling machine comprising:

apparatus configured and disposed to move containers into said filling machine to permit filling of containers with a liquid beverage;

apparatus configured and disposed to withdraw containers filled with a liquid beverage from said filling machine;

a supply arrangement configured and disposed to contain a supply of liquid beverage with which the containers are to be filled;

a supply arrangement configured and disposed to contain a supply of protective gas to protect the liquid beverage in a filled container;

at least one filling element configured and disposed to sealingly engage with the containers during filling;

apparatus configured and disposed to introduce the liquid beverage into a container sealingly engaged with each said at least one filling element through each said at least one filling element into a container;

a first evacuation system configured and disposed to remove air from the interior of a container sealingly engaged with each said at least one filling element;

apparatus configured and disposed to introduce a protective gas from said protective gas supply reservoir into a container sealingly engaged with each said at least one filling element;

a second evacuation system configured and disposed to remove and collect the introduced protective gas from the interior of a container;

said second evacuation system comprising an evacuation system being configured to be independent of said first, air, evacuation system; and control apparatus configured and disposed to control operations of said filling machine;

said method comprising the steps of:

feeding empty beverage containers into the filling machine;

engaging the empty beverage containers with each said at least one filling element and sealing the interiors of each of the beverage containers from the ambient air with each said at least one filling element such that the interiors of each of the beverage containers are in fluid communication with said liquid beverage supply arrangement and said protective gas supply arrangement;

evacuating the interior of each of the sealed beverage containers of air contained therein by pumping;

introducing the protective gas into the interior of each of the evacuated beverage containers to pressurize the beverage containers to a first pressure;

introducing the liquid beverage with which the pressurized beverage containers are to be filled into the interior of each of the evacuated beverage containers;

displacing protective gas by pumping the protective gas from the beverage containers containing the liquid beverage;

collecting protective gas displaced from the beverage containers;

disengaging each of the filled beverage containers from the corresponding filling element;

closing the filled beverage containers;

treating the displaced protective gas and recovering treated protective gas therefrom;

conducting treated protective gas into said protective gas supply arrangement; and introducing protective gas containing said treated protective gas into the interior of each of the evacuated beverage containers to pressurize the beverage containers to a first pressure.

10. The method of operating a plant for filling containers according to claim 10, wherein:

said protective gas comprises carbon dioxide.

11. The method of operating a plant for filling containers according to claim 10, wherein:

said liquid beverage supply arrangement and said protective gas supply arrangement together comprise a reservoir;

said reservoir being configured and disposed to maintain a supply of carbon dioxide gas and a supply of said liquid beverage;

said step of introducing the liquid beverage comprises introducing the liquid beverage from said reservoir;

said step of introducing the protective gas comprises introducing the protective gas from said reservoir.

12. The method of operating a plant for filling containers according to claim 11, wherein:

said filling machine comprises a conduit for conducting gas from a container;

said gas-conducting conduit being configured and disposed to be connected to said first evacuation system to remove air from a container and said gas-conducting conduit also being configured and disposed to be connected to said second evacuation system to remove carbon dioxide from a container;

said gas-conducting conduit being configured and disposed to remove in sequence both: air and carbon dioxide, from a container sealingly engaged with each said at least one filling element;

said first evacuation system comprises a first valve arrangement operatively connected to said control apparatus and to said gas-conducting conduit;

said first valve arrangement being configured and disposed to control the flow of air through said gas-conducting conduit from a container sealingly engaged with each said at least one filling element; and said second evacuation system comprises a second valve arrangement operatively connected to said control apparatus and said gas-conducting conduit;

said second valve arrangement being configured and disposed to control the flow of carbon dioxide gas through said gas-conducting conduit from a container sealingly engaged with each said at least one filling element.

13. The method of operating a plant for filling containers according to claim 12, wherein:

said first, air, evacuation system comprises a first vacuum pump to remove the air from a container; and said second evacuation system comprises a second vacuum pump to remove the carbon dioxide from a container;

said step of evacuating air comprises evacuating the air with said first vacuum pump;

said step of displacing carbon dioxide gas comprises pumping the carbon dioxide gas with said second vacuum pump.

14. A filling machine for a plant for filling containers with a liquid beverage, said filling machine comprising:

apparatus configured to move containers into said filling machine to permit filling of containers with a liquid beverage;

apparatus configured to withdraw containers filled with a liquid beverage from said filling machine;

a supply arrangement configured to contain a supply of liquid beverage with which the containers are to be filled;

an arrangement configured to supply a protective gas to protect the liquid beverage in a filled container;

at least one filling element configured to sealingly engage with the containers during filling;

apparatus configured to introduce the liquid beverage into a container sealingly engaged with each said at least one filling element through each said at least one filling element into a container;

a first evacuation system configured to remove air from the interior of a container sealingly engaged with each said at least one filling element;

apparatus configured to introduce a protective gas from said protective gas supply arrangement into a container sealingly engaged with each said at least one filling element;

a second evacuation system configured to remove protective gas from the interior of a container;

said second evacuation system comprising an evacuation system being configured to be independent of said first, air, evacuation system; and control apparatus configured to control said filling machine.

15. The filling machine according to claim 14, wherein:

said protective gas comprises carbon dioxide.

16. The filling machine according to claim 15, wherein:

each said at least one filling element comprises a passage configured to pass the liquid beverage into a container sealingly engaged with each said at least one filling element;

each said at least one filling element comprises an arrangement configured to open said passage to permit a flow of liquid beverage into a container and configured to close said passage to terminate the flow of liquid beverage into a container.

17. The filling machine according to claim 16, wherein:

said liquid beverage supply arrangement and said protective gas supply arrangement together comprise a reservoir;

said reservoir being configured to maintain a supply of carbon dioxide gas and a supply of said liquid beverage.

18. The filling machine according to claim 17, comprising:

a conduit for conducting gas from a container;

said gas-conducting conduit being configured to be connected to said first evacuation system to remove air from a container and said gas-conducting conduit also being configured to be connected to said second evacuation system to remove carbon dioxide gas from a container;

said gas-conducting conduit being configured to remove air and carbon dioxide from a container sealingly engaged with each said at least one filling element;

said first evacuation system comprises a first valve arrangement operatively connected to said control apparatus and to said gas-conducting conduit;

said first valve arrangement being configured to control the flow of air through said gas-conducting conduit from a container sealingly engaged with each said at least one filling element; and said second evacuation system comprises a second valve arrangement operatively connected to said control apparatus and said gas-conducting conduit;

said second valve arrangement being configured to control the flow of carbon dioxide gas through said gas-conducting conduit from a container sealingly engaged with each said at least one filling element.

19. The filling machine according to claim 18, wherein:

said first, air, evacuation system comprises a first vacuum pump to remove air from a container; and said second, carbon dioxide, evacuation system comprises a second vacuum pump to remove the carbon dioxide gas from a container.

20. The filling machine according to claim 19; wherein:

said second pump is configured to remove the carbon dioxide gas prior to and/or during filling of a container with the liquid beverage; and said filling machine comprises a counter pressure filling machine.

* * * * *

UNITED STATES PATENT AND TRADEMARK OFFICE

CERTIFICATE OF CORRECTION

PATENT NO. : 6,470,922 B2
DATED : October 29, 2002
INVENTOR(S) : Siegmar Sindermann It is certified that error appears in the above-identified patent and that said Letters Patent is hereby corrected as shown below:

Column 25,
Line 49, after 'claim', delete "10," and insert -- 9, --.

Signed and Sealed this

Twentieth Day of May, 2003

JAMES E. ROGAN
*Director of the United States Patent and Trademark Office*